United States Patent [19]

Thompson

[11] 4,341,172

[45] Jul. 27, 1982

[54] SEWING MACHINE CONVERSION APPARATUS

[76] Inventor: Elmer R. Thompson, 2408 47th St., Lubbock, Tex. 79412

[21] Appl. No.: 159,109

[22] Filed: Jun. 13, 1980

Related U.S. Application Data

[63] Continuation-in-part of Ser. No. 81,345, Oct. 3, 1979, Pat. No. 4,296,703.

[51] Int. Cl.[3] ..... D05B 27/00; D05B 27/20

[52] U.S. Cl. ..... 112/310; 112/311; 112/316; 112/320

[58] Field of Search ..... 112/310, 311, 316, 317, 112/314, 320, 321

[56] References Cited

U.S. PATENT DOCUMENTS

| | | | |
|---|---|---|---|
| 1,221,138 | 4/1917 | Chadwick | 112/317 |
| 2,470,759 | 5/1949 | Clayton | 112/320 |
| 3,094,087 | 6/1963 | Thorne | 112/310 |
| 3,331,344 | 7/1967 | Haugan | 112/317 X |
| 3,570,427 | 3/1971 | Wenz | 112/320 |
| 3,583,343 | 6/1971 | Meier et al. | 112/320 |
| 3,605,662 | 9/1971 | Willenbachor | 112/320 |
| 3,935,826 | 2/1976 | Nicolay et al. | 112/320 |
| 3,952,675 | 4/1976 | Thompson | 112/320 |
| 3,970,018 | 7/1976 | Hager | 112/310 |

FOREIGN PATENT DOCUMENTS

| | | | |
|---|---|---|---|
| 2620209 | 11/1977 | Fed. Rep. of Germany | 112/320 |

*Primary Examiner*—H. Hampton Hunter
*Attorney, Agent, or Firm*—E. Harrison Gilbert, III

[57] ABSTRACT

An apparatus is disclosed which is to be connected to a domestic sewing machine for converting it into one capable of sewing heavier materials and sewing materials having edgewise designs so that the designs are maintained in alignment. The converted machine can also be capable of having an adjustable amount of hook throw. This apparatus includes a member which pivotally connects a needle bar and a feed foot to the sewing machine. The apparatus also includes a member which pivots the connecting member back and forth in a feed direction and a reverse feed direction. So that the workpiece being sewn by the machine will not slip during pivoting in the reverse feed direction, the apparatus also includes a clamp element for retaining the workpiece against a workpiece supporting surface during this time. Additionally the apparatus includes a mechanism which lowers and raises a feed dog when the connecting member has been pivoted to the substantial extremes of the feed direction and reverse-feed direction. The apparatus may also include an element which can be adjustably set to determine the amount of thread thrown by the hook contained in the sewing machine. The present invention also includes elements for operating the sewing machine having an oscillatory thread hook in either a forward stitch mode or a reverse stitch mode.

16 Claims, 13 Drawing Figures

SEWING MACHINE CONVERSION APPARATUS

RELATED APPLICATION

This is a continuation-in-part of my co-pending U.S. patent application Ser. No. 81,345 entitled "Sewing Machine Conversion Apparatus" and filed Oct. 3, 1979, now U.S. Pat. No. 4,296,703 dated Oct. 27, 1981.

BACKGROUND OF THE INVENTION

1. Field of the Invention

The present invention relates generally to sewing machine feed conversion apparatus, and more particularly, but not by way of limitation, to an apparatus for attachment to a sewing machine having a bottom workpiece feed mechanism and a top presser foot mechanism to convert the machine to one having a reverse-pivoted bottom workpiece feed mechanism, a top workpiece feed mechanism (which includes the conversion of the top presser foot mechanism to a workpiece feed foot mechanism), a top workpiece clamping mechanism and an adjustable hook throw mechanism whereby workpieces of extra thickness can be fed and sewn through the machine and whereby workpieces having designs which are to be matched at their seams can be more easily maintained in alignment and sewn and whereby workpieces can be sewn with variable amounts of thread throw.

2. Description of the Prior Art

Various sewing machine apparatus for both domestic use and commercial use have been developed. Generally, sewing machines intended for domestic use include bottom workpiece feed mechanisms. That is, these machines include a feed dog which is positioned in the work supporting surface of the machine and which is raised, moved in the direction of feed, lowered and moved in the opposite direction with each cycle of the sewing needle. In domestic machines the raising and feed-direction movements of the feed dog occur while the needle is placed in non-sewing positions, whereas the lowering and reverse feed direction movements of the dog occur while the needle is placed to penetrate and stitch the workpiece. Such machines also include a presser foot mechanism for urging the workpiece being stitched against the work supporting surface so that the feed dog contacts the workpiece and moves it forward when the feed dog is raised and moved in the direction of feed.

Sewing machines intended for commercial use, on the other hand, generally include feed mechanisms which grip both the top and bottom surfaces of the workpiece whereby the workpiece can be of extra thickness but still be fed through the mechanism and stitched by the machine. Such top and bottom workpiece gripping feed mechanisms usually include a feed dog, similarly positioned below the workpiece as in the domestic machine but moved through the various positions at different times with respect to the position of the needle, and a feed foot mechanism, positioned above the workpiece and moved in timed relationship with the feed dog to advance the workpiece. In other words, the feed foot is lowered into contact with the top surface of the workpiece, the feed dog is raised into contact with the bottom surface of the workpiece, and then both are moved in the direction of feed so that the workpiece is advanced. The stitching of the workpiece also occurs during this time of the feed dog's raising and feed-direction movements. As will be noted, this is contrary to the timing of the domestic machines. Such simultaneous top and bottom workpiece gripping feed mechanisms make it possible for extra thick workpieces or multi-layered workpieces to be advanced and stitched by the machine. Having the feed foot mechanism converted from the top presser foot mechanism and having the converted mechanism and needle bar pivotally connected to the sewing machine makes it possible to better maintain the alignment of workpieces which have designs that are to be matched along the seams of the workpiece.

Additionally, sewing machines intended for commercial use may include mechanisms for adjustably controlling the amount of throw on the hook used to loop the needle-fed thread around the bobbin. This throw adjustability feature permits improved sewing capabilities over those exhibited by domestic-type, fixed-throw sewing machines.

Furthermore, a sewing machine having a compound needle feed mechanism which can be driven to effect either a forward stitch or a reverse stitch normally includes a rotational hook, as opposed to an oscillatory hook, so that the hook and needle appropriately work together in either the forward or reverse stitch directions.

Therefore, it is apparent that sewing machines intended for domestic use have the shortcoming of lacking the versatility possessed by a commercial sewing machine. Although sewing machines intended for commercial use may have the additional features, they have the shortcoming of generally being considerably more expensive than domestic sewing machines. Also sewing machines which have compound needle feed mechanisms for bi-directional stitching lack the ability to properly function with an oscillatory hook. Therefore, there is the need for relatively inexpensive conversion apparatus which can be attached to a domestic machine to convert it to one having capabilities of a commercial machine. There is also the need for such conversion apparatus to permit an oscillatory hook to be used with a compound needle feed mechanism so that both forward and reverse stitching can be performed by the converted machine without having to use a fully rotating hook.

Although a conversion apparatus has been proposed in the U.S. Pat. No. 3,942,675 issued to Thompson, it fails to disclose the various features of the conversion apparatus of the present invention.

SUMMARY OF THE INVENTION

The present invention overcomes the above-noted and other shortcomings of the prior art by providing a novel, useful and improved sewing machine conversion apparatus. This apparatus is for attachment to a domestic-type sewing machine to convert it to one which includes the previously discussed features of commercial-type sewing machines, yet which is not as expensive as such commercial sewing machines.

The present invention is directed to an apparatus for converting a sewing machine capable of sewing lightweight material to one capable of sewing heavier material and also to one capable of maintaining in edgewise alignment designs which are to be connected along the seams of the material. The present invention is also directed to an apparatus for enabling a sewing machine having an oscillatory hook to function with a compound needle mechanism which can stitch in either a forward direction or a reverse direction. The unconverted sewing machine includes a main crankshaft coupled to a primary lift shaft and to a primary feed shaft for transmitting the drive power throughout the machine. The unconverted machine further includes a feed dog for feeding the workpiece across a workpiece supporting surface of the machine. The conversion apparatus of the present invention cooperates with these elements and includes a means for pivotally connecting a needle bar and a feed foot to the sewing machine, means responsive to actuation of the primary feed shaft for oscillatably pivoting the connecting means in a feed direction and a reverse feed direction, means responsive to actuation of the primary lift shaft for clamping the workpiece against the workpiece support surface during the reverse-feed direction pivotation, and means responsive to actuation of the primary lift shaft for lowering and raising the feed dog at the substantial extreme of the feed direction pivotation and at the substantial extreme of the reverse-feed direction pivotation, respectively. The apparatus may also comprise a means for adjustably setting the amount of throw on the hook which loops the thread fed by the needle around the bobbin contained within the sewing machine. The apparatus further includes means for repositioning the throw mechanism of the sewing machine as the position of the needle changes in response to a change in the stitching direction of the needle.

Therefore, from the foregoing, it is a general object of the present invention to provide a novel, useful and improved sewing machine conversion apparatus. Other and further objects, features and advantages of the present invention will be readily apparent to those skilled in the art upon a reading of the description of the preferred embodiment which follows, when taken in conjunction with the accompanying drawings.

BRIEF DESCRIPTION OF THE DRAWINGS

FIG. 6 is a partial side elevation view of the FIG. 1 embodiment with elements shown in a second position.

DETAILED DESCRIPTION OF A PREFERRED EMBODIMENT OF THE PRESENT INVENTION

Figure 1:
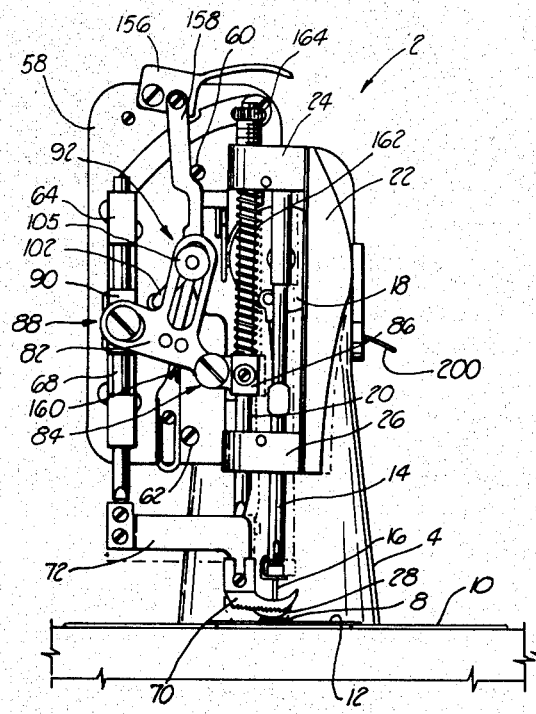
FIG. 1 is a side elevation view of a sewing machine exhibiting a portion of the present invention.
Figure 2:
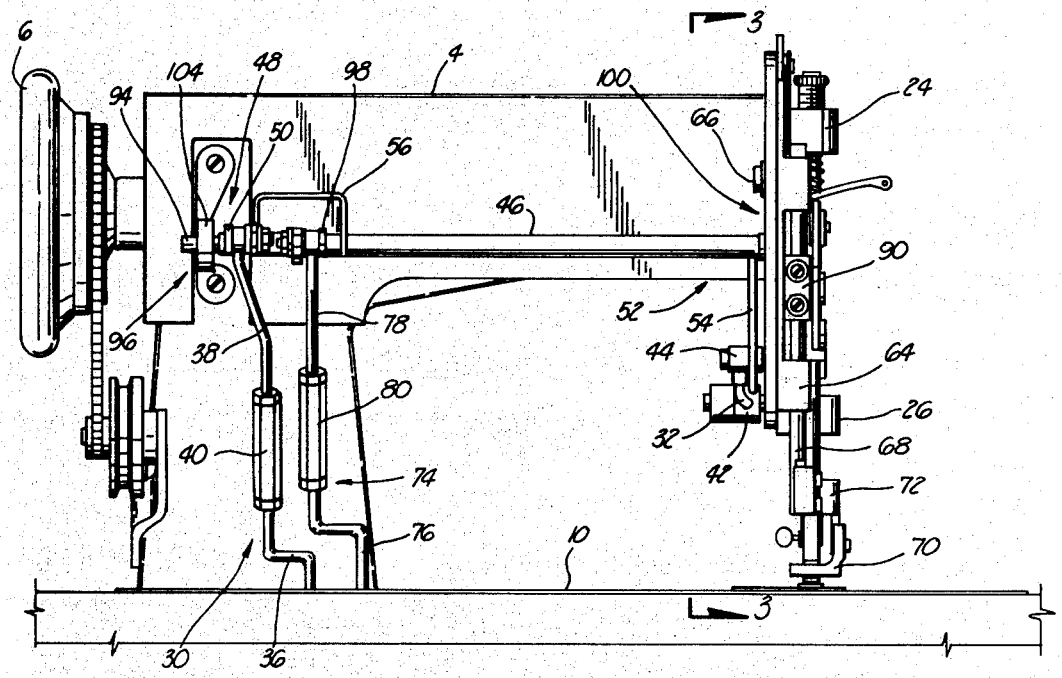
FIG. 2 is a rear elevation view of a sewing machine exhibiting another portion of the present invention.

With reference to the drawings and in particular to FIGS. 1–5, the apparatus of the present invention will be described. Initially, those elements ordinarily found in a sewing machine intended for domestic use will be identified. The sewing machine itself is generally identified in the drawings by the reference numeral 2. The sewing machine 2 includes a housing 4 as shown in FIG. 1. Contained within the housing 4 is a main crankshaft which is coupled to a primary lift shaft and a primary feed shaft. FIG. 2 indicates that a crankshaft drive wheel 6 is connected to one end of the main crankshaft for coupling either manual or powered drive to the main crankshaft. The primary lift shaft and the primary feed shaft are coupled to the main crankshaft so that they are moved thereby in a predetermined relationship to provide basic timed drive power to the remainder of the sewing machine elements.

FIG. 1 also discloses a bottom workpiece feed mechanism comprised of a feed dog 8. The feed dog 8 is raised and lowered in response to movement by the primary lift shaft and is moved in a feed direction and the direction opposite thereto by movement of the primary feed shaft. In a normal domestic type of sewing machine, the feed dog 8 has an upper serrated surface for gripping a workpiece and feeding it through the sewing machine. However, in the present invention, the feed dog 8 has, in its preferred embodiment, a smooth upper surface so that it will not bind or tear the workpiece when pressure may be applied by a feed foot subsequently described herein. The feed dog 8 is disposed within a workpiece supporting surface 10.

Figure 4:
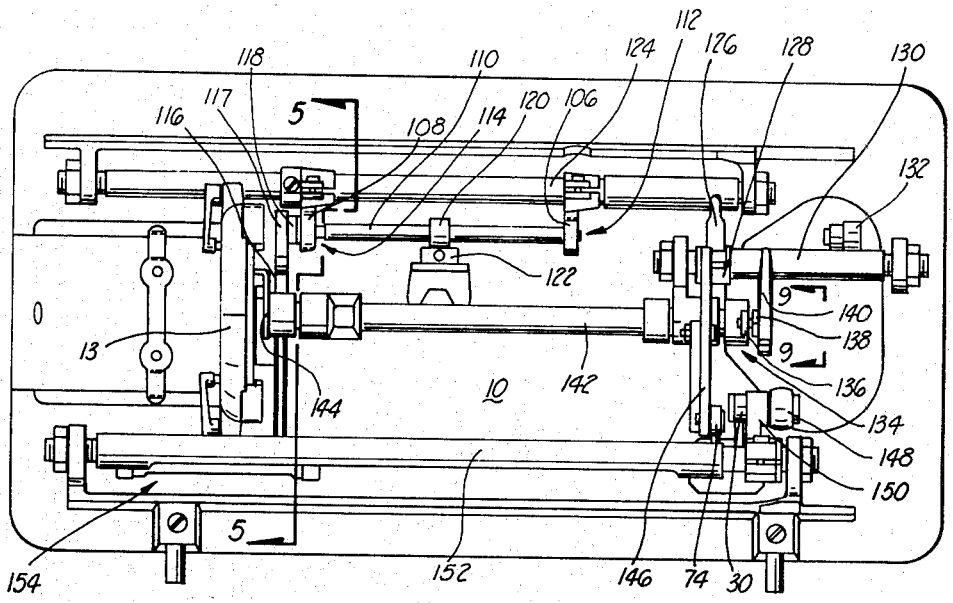
FIG. 4 is a bottom plan view of a sewing machine exhibiting a further portion of the present invention.
Figure 5:
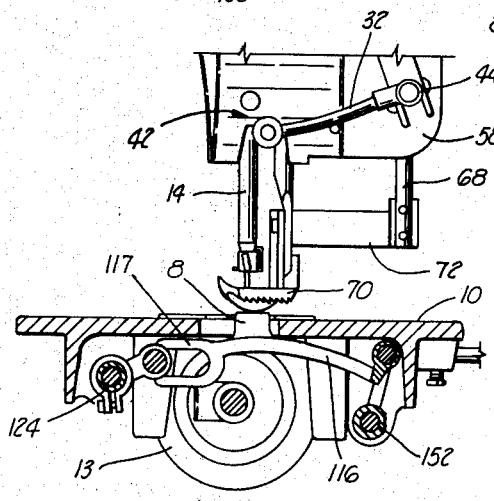
FIG. 5 is a partial sectional elevation view taken in the direction indicated by line 5—5 shown in FIG. 4.

FIG. 1 further shows a bobbin housing covering means 12 placed over a hook-and-bobbin housing 13, shown in FIGS. 4–5, which contains a hook for catching thread fed by a needle and looping or throwing the thread around a bobbin also contained in the housing.

A normal domestic machine further includes a needle bar 14 having a needle 16 depending therefrom for effecting the stitching of the workpiece. The needle bar 14 and depended needle 16 are substantially vertically oscillated by a wheel-and-arm assembly 18 which operates in response to rotation of the main crankshaft.

Additionally, a domestic machine includes a presser bar 20 having a presser foot connected thereto, which foot is normally retained in a lowered position to urge the workpiece against the feed dog 8 and the workpiece supporting surface 10. As will be subsequently described hereinbelow, the presser bar 20 is utilized in the present invention, but a feed foot is substituted for the presser foot.

For effecting the conversion of a domestic type sewing machine having these components into one having a top and bottom workpiece gripping feed mechanism whereby workpieces of extra thickness can be fed through the mechanism, maintained in edgewise alignment and stitched, the apparatus of the present invention includes means for pivotally connecting the needle bar 14 and a feed foot to the sewing machine 2, means for oscillatably pivoting such a connecting means in both a feed direction and a reverse-feed direction in response to actuation of the primary feed shaft, means for clamping the workpiece against the workpiece supporting surface 10 during pivotation of the connecting means in a reverse-feed direction in response to actuation of the primary lift shaft, and means for lowering and raising the feed dog at the substantial extreme of the pivotation of the connecting means in the feed direction and at the substantial extreme of the pivotation of the connecting means in its reverse-feed direction, respectively, in response to actuation of the primary lift shaft. This apparatus may also include a means for adjustably setting the amount of throw on the hook contained within the bobbin housing 13.

FIG. 1 discloses that the means for pivotally connecting the needle bar 14 and a feed foot to the sewing machine 2 includes a first frame 22 pivotally connected to the sewing machine. The frame 22 has a plurality of bores defined in a first yoke section 24 and a second yoke section 26 thereof. These bores in the preferred embodiment extend substantially vertically through the respective yoke sections. Slidably received within respective ones of these bores are the needle bar 14 and the presser bar 20. In the preferred embodiment these bars 14 and 20 are held by the frame 22 in substantially parallel spaced relation to each other. Once the conversion of the sewing machine has been made, this presser bar 20 becomes a frame-engaging leg extending upward from a feed foot 28 connected to the lower portion thereof as shown in FIG. 3.

Figure 3:
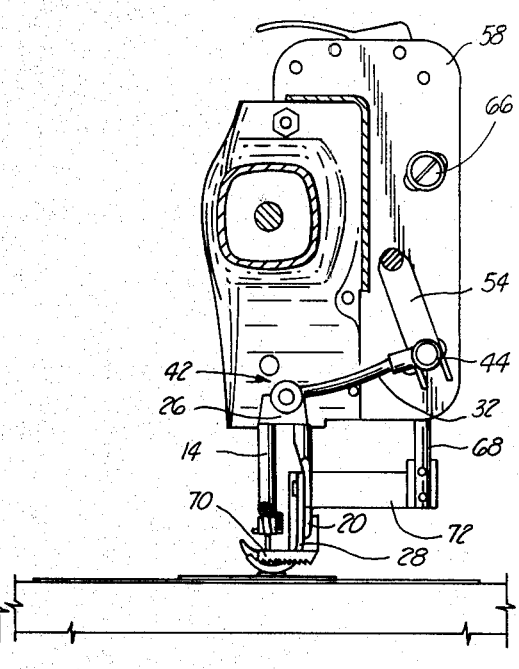
FIG. 3 is an elevation view taken in the direction indicated by line 3—3 shown in FIG. 2.

The means for oscillatably pivoting the connecting means is shown in FIGS. 2 and 3 to include a feed rod 30, a pivot arm 32 and means for transmitting movement by the feed rod 30 to the pivot arm 32.

FIG. 2 shows that the preferred embodiment of the feed rod 30 includes a lower segment 36 and an upper segment 38 connected by a first connector 40 which may be used to adjust the length of the feed rod 30. The lower end of the feed rod 30 is linked to the primary feed shaft as will be shown later.

The pivot arm 32 includes a first end 42 and a second end 44 as shown in FIGS. 2 and 3. The first end 42 is shown connected to the rear of the first frame 22, and the second end 44 is shown connected to the movement transmitting means.

This movement transmitting means more particularly includes a crank-containing tube 46 having a first tube end 48 with which a first tube crank 50 is more closely associated and also having a second tube end 52 with which a second tube crank 54 is more closely associated. The first tube crank 50 is pivotally connected to the feed rod 30, and the second tube crank 54 is pivotally connected to the second end 44 of the pivot arm 32. Interconnecting separate portions of the crank-containing tube 46 is a strap member 56.

The means for clamping the workpiece against the workpiece supporting surface 10 during reverse-feed direction pivotation is shown in FIG. 1 to include a second frame 58 connected to the sewing machine 2 by any appropriate means, such as screws 60 and 62. The clamping means further includes a tubular member 64 which, in the preferred embodiment, is connected substantially vertically to the second frame 58 by means of a screw 66, shown in FIG. 8. Slidably engaged within the tubular member 64 is a workpiece retainer rod 68. Connected to the end of the workpiece retainer rod 68 is a means for retaining the workpiece against the workpiece supporting surface 10. In the preferred embodiment shown in FIG. 1, this retaining means includes a workpiece retainer foot 70 having an ankle member 72 extending therefrom for connection to the workpiece retainer rod 68. Thus, in the preferred embodiment the workpiece retainer foot 70 depends from the workpiece retainer rod 68. FIGS. 1–3 collectively indicate that the preferred embodiment workpiece retainer foot 70 has a substantially U-shaped configuration movably disposed around a substantial portion of the periphery of the feed foot 28.

FIG. 2 reveals that the clamping means further includes a lift rod 74 which is linked to the primary lift shaft as subsequently described. The lift rod 74 is shown to include a lower portion 76 and an upper portion 78 connected by a second connector 80 which may be used to adjust the length of the lift rod 74.

The clamping means further includes a means for conveying movement by the lift rod 74 to the retainer foot rod 68. This conveying means includes linkage means comprising a bell crank 82 having a first pivot end 84 connected to the presser bar 20 by attachment to a collar 86 of the presser bar 20, having a second pivot end 88 connected to the workpiece retainer rod 68 by means of a block 90 thereof, and having a third pivot end 92. The third end 92 is pivotally connected to a means for communicating movement by the lift rod 74 to the third pivot end of the bell crank 82.

This communicating means includes a crankable rod 94 having a first crank rod end 96 with which a first rod crank 98 is closely associated and having a second crank rod end 100 with which a second rod crank 102 is closely associated. The rod 94 is journaled in a bearing mount 104 near the first crank rod end 96 and is journaled in the second frame 58 near the second crank rod end 100. Disposed substantially concentrically around the crankable rod 94 is the crank-containing tube 46 of the oscillatably pivoting means, as shown in FIG. 2. In the preferred embodiment, the communicating means is connected to the third pivot end 92 by means of a retaining disk 105 placed over the end of the second rod crank 102 and the face of the third pivot end 92.

The means for lowering and raising the feed dog 8 is shown in FIG. 4 to include a first feed dog elevation crank 106, a second feed dog elevation crank 108, a lever 110, and a means for transferring movement by the primary lift shaft to the first elevation crank 106.

The lever 110 includes a first end 112 connected to the first crank 106 and also includes a second end 114 connected to the second crank 108 and the feed dog 8. This connection to the feed dog 8 is made through a feed dog support arm 116 which has the feed dog 8 extending therefrom and which also has a forked end 117 extending therefrom. The forked end 117 communicates with a rotatable sleeve 118 which is rotatably associated with the second end 114 of the lever 110 and the second crank 108. The lever 110 is pivotally connected to the sewing machine by means of a collar member 120 connected to the lever 110 and having a pin extending therefrom for pivotal communication with a pin-receiving socket member 122 connected to the bottom of the workpiece supporting surface 10. The lever 110 is pivoted in response to the movement transferring means.

The movement transferring means is a means for coupling the first elevation crank 106 to the primary lift shaft. FIG. 4 indicates that this coupling comprises a mounting shaft 124 to which the first feed dog elevation crank 106 is connected. In the preferred embodiment shown in FIG. 4 the second feed dog elevation crank 108 is mounted on the shaft 124 for independent rotation thereabout. Also connected to the mounting shaft 124 is a mounting shaft crank 126 which is oscillated by means of a cam 128 mounted on a camshaft 130. The camshaft 130 is connected to an end 132 of the primary lift shaft as shown in FIG. 4.

Figure 9:
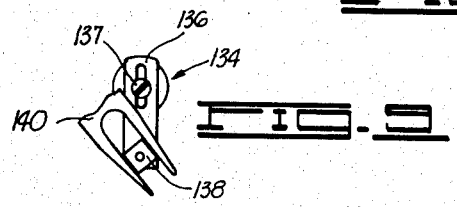
FIG. 9 is an elevation view taken in the direction indicated by line 9—9 in FIG. 4.

The means for adjustably setting the amount of throw on the hook, which may also be included in the apparatus of the present invention, includes a hook throw crank 134 having a variable length arm 136 extending therefrom as shown in FIGS. 4 and 9. The variable length arm 136 is adjustably secured to the throw crank 134 by means of a fastening element 137 disposed through a slot formed in the arm 136 as shown in FIG. 9. At the end opposite that which is adjustably fastened to the crank 134 is a rotatable block 138 which extends from the crank 134 into the inner periphery of a forked extension 140 projecting from the camshaft 130. The interaction between the crank 134 and the forked extension 140, as moved by the primary lift shaft, effects oscillatory rotation of a hook throw rod 142 and a throw mechanism 144 connected thereto. The adjustability of the amount of throw is obtained by presetting the variable length arm 136 to a specific length for linkage to the primary lift shaft so that the amount of throw is thereby determined.

In addition to the preceding elements, FIG. 4 discloses a synchronizing linkage means 146 pivotally connected to the mounting shaft crank 126 at one end thereof and to the lift rod 74 at the other end thereof so that the movement of the lift rod 74 is synchronized with the movement of the primary lift shaft coupled to the camshaft 130.

FIG. 4 further reveals that an end 148 of the primary feed shaft is coupled to the feed rod 30 and to a feed dog feed direction shaft crank 150 for communicating oscillatory movement to a feed direction shaft 152 extending from the feed direction shaft crank 150. The feed direction shaft 152 is pivotally connected to the feed dog support arm 116, as generally indicated in FIG. 4 by the reference numeral 154.

FIG. 4 additionally shows that each of the previously discussed shafts disclosed therein are journaled in appropriate bearing structure which extend from the bottom of the workpiece supporting surface 10.

With reference again to FIG. 1, an additional feature will be described. This feature is the manual feed foot and workpiece retainer foot lift mechanism. This mechanism has a lift lever 156 and a lift bar 158. The lift bar 158 has a lift shoulder 160 extending therefrom for contacting a flange extending from the rear of the bell crank 82 when lifting of the feed foot and workpiece retainer foot elements is desired.

FIG. 1 further shows a spring 162 disposed over the upper portion of the presser rod 20 between the first yoke 24 and the collar 86. Connected to the opposite side of the first yoke 24 from the spring 162 is a spring tensioning member 164.

With reference to FIGS. 10–13 a modification of the embodiment disclosed in FIGS. 1–9 will be described. It is to be noted that for this modification to be necessary the sewing machine will include stitch direction control means for controlling the feed direction of a compound needle feed mechanism. The stitch direction control means is of the type as is known in the art and may include, for example, a control lever 200 as shown in FIGS. 1, 6, 7 and 8. With the lever 200 in the position shown in these drawings the sewing machine is in a forward stitch direction mode. When the lever 200 is raised to an upper location, the sewing machine is in a reverse stitch direction mode. The movement of the lever 200 from one mode to the other causes the compound needle feed mechanism, which includes the needle bar assemblage as previously described hereinabove, to reposition itself with respect to the throw mechanism 144 and the needle-fed thread hook included therein. Because of this movement of the needle feed mechanism with respect to the throw mechanism, the sewing machine needs means for repositioning the throw mechanism 144 so that the needle and the thread hook are properly realigned to effect the newly selected stitch direction. This repositioning means is the modification depicted in FIGS. 10–13.

Before proceeding with the description of the repositioning means, which is generally indicated by the reference numeral 202, it is also to be understood that the sewing machine includes means for imparting oscillatory movement to the throw mechanism 144. This oscillation means has also been previously described hereinabove with reference to the means for adjustably setting the amount of throw on the hook.

Figure 10:
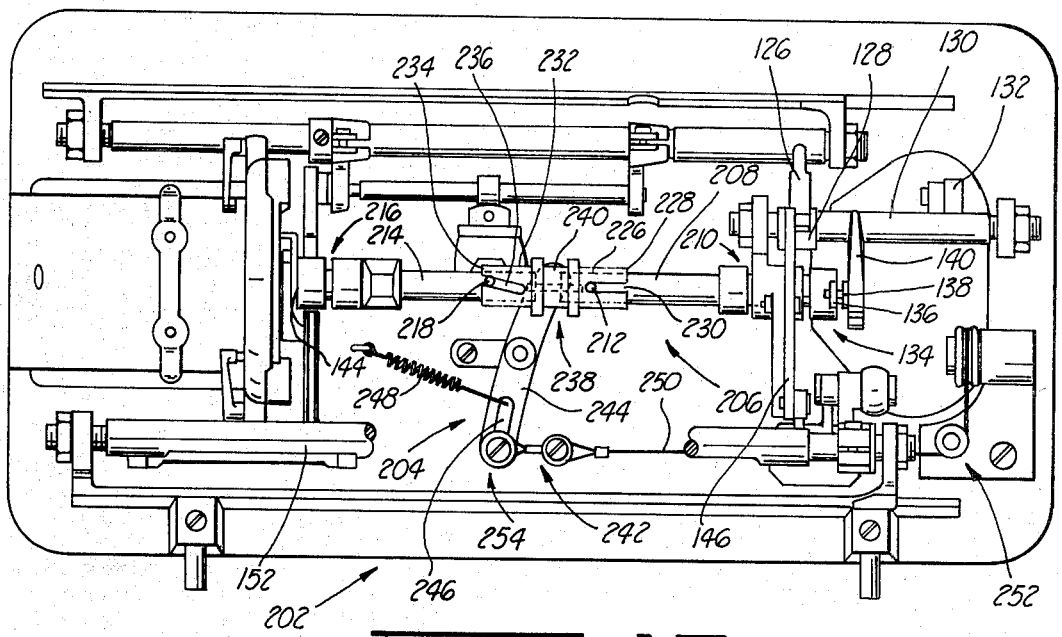
FIG. 10 is a bottom plan view of a sewing machine exhibiting the throw mechanism repositioning means of the present invention.

The repositioning means 202 of the preferred embodiment shown in FIG. 10 includes means 204 for rotating the throw mechanism 144 so that the hook attached thereto is rotated into a position to properly correspond to the repositioning of the compound needle feed mechanism which results from a change in the setting of the stitch direction control means. The repositioning means 202, and more particularly the rotating means 204 for the preferred embodiment shown in FIG. 10, interacts with elements of the oscillation means to effect the movement or repositioning of the throw mechanism 144. This portion of the oscillation means includes connecting means 206 for connecting an oscillation drive means to the throw mechanism 144. The oscillation drive means includes the previously discussed elements which impart oscillatory movement to the hook throw rod 142 shown in FIG. 4.

Figure 13:
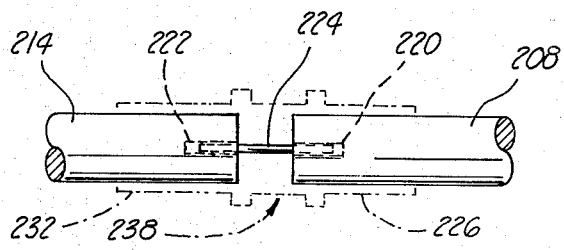
FIG. 13 is a partial view of the hook throw rod as constructed for use with the repositioning means shown in FIG. 10.

Instead of including the single rod 142 as shown in the FIG. 4 embodiment, the connecting means 206 of the FIG. 10 embodiment includes a first hook throw rod section 208 having a first end 210 connected to the oscillation drive means and having a first radially extending guide pin 212. The FIG. 10 connecting means 206 further includes a second hook throw rod section 214 having a first end 216 connected to the throw mechanism 144 and having a second radially extending guide pin 218. The first and second hook throw rod sections 208 and 214 are shown in FIG. 13 to include longitudinally extending openings 220 and 222, respectively, in the respective second ends thereof. Movably positioned within and extending between the openings 220 and 222 is an elongated alignment member 224, such as a floating pin. The alignment member 224 comprises a further element of the connecting means 206 of the FIG. 10 embodiment of the oscillation means.

Interacting with the first and second hook throw rod sections 208 and 214 is the rotating means 204. The rotating means 204 includes means for coupling the first hook throw rod section 208 with the second hook throw rod section 214. Specifically, the coupling means includes a first sleeve 226 extending over a second end of the first hook throw rod section 208. The first sleeve 226 has an edge 228 from which a longitudinally extending guide slot 230 extends into the tubular wall defining the first sleeve 226. The longitudinally extending guide slot 230 receives the first guide pin 212 when the first sleeve 226 is extended over the second end of the first hook throw rod section 208 as shown in FIG. 10.

The coupling means further includes a second sleeve 232 which is connected to the first sleeve 226. The second sleeve 232 includes an edge 234 having a slot 236 extending obliquely therefrom into the tubular wall defining the preferred embodiment of the second sleeve 232 as shown in FIG. 10. The guide slot 236 formed in the second sleeve 232 is skewed with respect to the longitudinal axis of the second sleeve. The skewed or obliquely extending guide slot 236 of the second sleeve receives the second guide pin 218 radially extending from the second hook throw rod section 214.

The first sleeve 226 and the second sleeve 232 are connected or integrally formed with a collar section 238 having a circumferentially extending groove 240 defined therein. The collar section coacts with a sliding means 242.

The sliding means 242 is responsive to the stitch direction control means and slides the first and second sleeves 226 and 232 with respect to the first and second hook throw rod sections 208 and 214 so that the second guide pin 218 coacts with the skewed guide slot 236 to rotate the throw mechanism 144 and thereby reposition it with respect to the compound needle feed mechanism. The sliding means 242 includes an arcuate member 244 pivotally connected to the sewing machine. The arcuate member 244 has a first end portion which is generally associated with the first and second sleeves and which is more particularly movably associated with the collar section 238. As shown in FIG. 10, the arcuate member 244 is pivotally mounted to the sewing machine at a substantially central point. FIG. 10 further shows that the arcuate member 244 includes a slot 246 defined therein adjacent a second end thereof.

Associated with the slot 246 is means, responsive to the stitch direction controlling means, for pivoting the arcuate member 244 so that the first and second sleeves 226 and 232 slide with respect to the first and second hook throw rod sections 208 and 214. This pivoting means particularly includes a spring 248 having one end anchored to the sewing machine and having a second end hooked within the slot 246 of the arcuate member 244. The pivoting means further includes pull means having one end connected to the lever 200 and having a second end adjustably connected within the slot 246. The second end is adjustably connected so that the degree of pivotation of the arcuate member 244, and thus the distance which the first and second sleeves 226 and 232 are moved with respect to the first and second hook throw rod sections 208 and 214, cam be changed to achieve the proper setting with respect to the amount of movement exhibited by the compound needle feed mechanism in response to a change in the stitch direction setting. For the preferred embodiment shown in FIG. 10, the pull means is shown to include a wire 250 extending from the lever 200 to the arcuate member 244. Changes in direction of the wire 250 are effected by means of a plurality of pulleys 252 so that proper movement of the wire can be achieved when the lever 200 is moved. Adjustable connecting means 254 connecting the second end of the wire 250 to the arcuate member 244 includes an appropriate nut and bolt combination, or other suitable connector.

Having thus described the various elements of the apparatus of the present invention, the operation of the elements will next be described. First, however, the operation of an unconverted, domestic-type sewing machine will be briefly examined. The point of reference for the timing and position relationships in the following discussion will be the position of the wheel-and-arm assembly 18 as shown in FIGS. 1, 6, 7 and 8. Additionally, references to "up", "down", "forward" and "rearward" and their equivalents refer, respectively, to the direction generally extending from the workpiece supporting surface 10 to the first frame 22, the direction opposite thereto, the direction in which the workpiece is fed as it is stitched (in FIGS. 1, 6–8 this is from the right-hand side of the drawing to the left-hand side), and the reverse-feed direction (i.e., from left to right in FIGS. 1 and 6–8).

Figure 7:
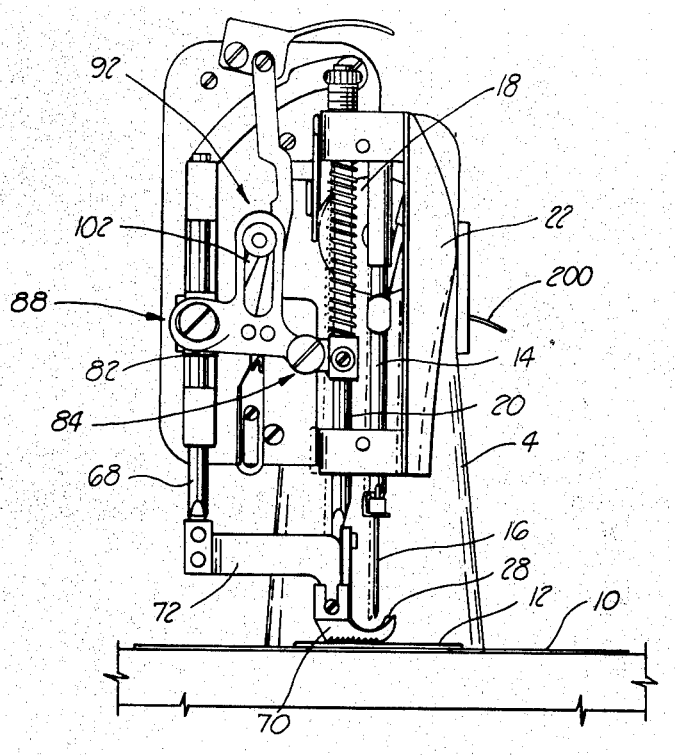
FIG. 7 is a side elevation view of the FIG. 1 embodiment with elements shown in a third position.
Figure 8:
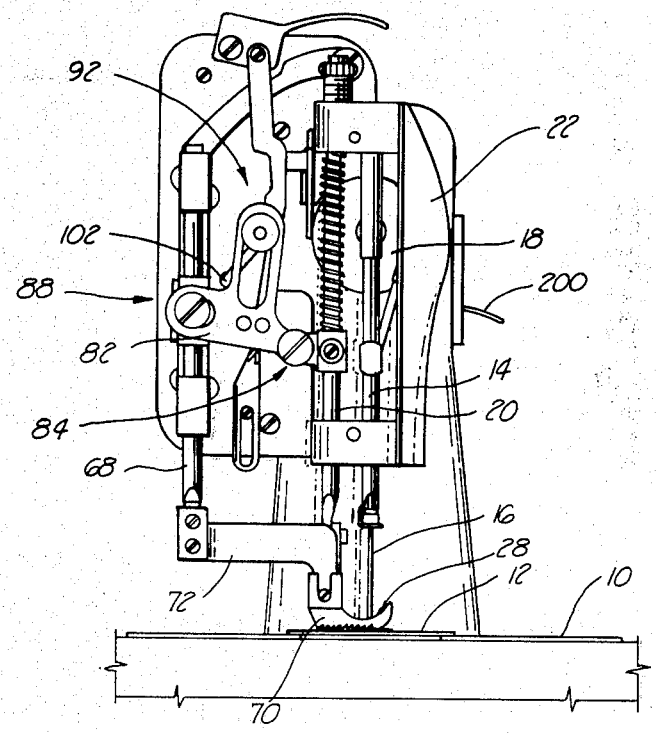

With respect to an unconverted sewing machine constructed for domestic use, when the assembly 18 is in the position as shown in FIG. 1, the needle in such machine is being withdrawn from its downwardmost position and the feed dog is down and forward. In the FIG. 6 position of the assembly 18, the domestic machine has more fully retracted the needle upward and the feed dog is down and to the rear. With the assembly 18 in the position as shown in FIG. 7, the needle of the domestic machine has moved past its zenith and the dog has moved up, remaining to the rear. As the assembly 18 is rotated on into the FIG. 8 position, the needle is moved downward and the feed dog is moved forward and begins to move down into its FIG. 1 position. During rotation of the assembly 18 back to its FIG. 1 position, the feed dog is fully lowered and the needle is driven through the workpiece. In summary, in a domestic machine as the needle is driven downward the feed dog is moved forward and downward, with the needle not penetrating the workpiece until after the full forward movement has occurred. As the needle is retracted, the feed dog is moved to the rear and upward.

The sewing machine having an apparatus of the present invention attached thereto, on the other hand, cycles through the following positions. In the FIG. 1 position of the assembly 18, the needle 16 is substantially at its nadir, the feed dog 18 is up and forward, the feed foot 28 is down and forward and the workpiece retainer foot 70 is up. Rotating the assembly 18 into its FIG. 6 position draws the needle 16 upward, drops the feed dog 8 down while maintaining it forward, maintains the feed foot 28 down and forward, maintains the feed foot 28 down and forward and drops the workpiece retainer foot 70 down. Rotating the assembly 18 on into its FIG. 7 position moves the needle 16 to the rear, retracts it to its zenith and commences its next downward stroke, moves the feed dog 8 to the rear while maintaining it down, pulls the feed foot 28 up and rearward and maintains the workpiece retainer foot 70 down. Rotation of the assembly 18 from its FIG. 7 to its FIG. 8 position substantially completes the rearward position of the needle 16 and the feed foot 28 in the first frame 22, drives the needle 16 farther downward, moves the feed dog 8 upward while maintaining it to the rear, drops the feed foot 28 down, and maintains the workpiece retainer foot 70 down. As the assembly 18 rotates from its FIG. 8 position to its FIG. 1 position the needle 16 is driven through the workpiece to stitch it, the workpiece retainer foot 70 is pulled up, the first frame 22 is pivoted forward thereby moving the needle 16 and the feed foot 28 forward, the feed dog 8 is moved forward while being retained up, and the feed foot 28 remains down but is moved forward. In summary, the converted sewing machine having the apparatus of the present invention attached thereto functions so that as the needle 16 is driven downward, the feed foot 28 is moved down to secure the workpiece against the upwardly drawn feed dog 8, the workpiece retainer foot 70 is drawn upward from its engagement with the workpiece, and the needle 16, the feed dog 8 and the feed foot 28 are pivoted forward to feed the workpiece through the machine. The needle 16 penetrates and stitches the workpiece as it is fed forward. As the needle of the converted machine is retracted, the workpiece retainer foot 70 is dropped down to retain the workpiece against the workpiece supporting surface 10, the feed dog 8 is moved down and the feed foot 28 is moved up to thereby disengage their grip on the workpiece. The feed dog 8 and the feed foot 28 then are moved to the rear by the pivotation of the first frame 22 in preparation of the next cycle where they will again grip the workpiece, stitch it and feed it forward.

Thus it is apparent that the relative timing of the particular movements of various elements are different between the unconverted and the converted sewing machines. A portion of this timing difference is effected by the particular connection between the main crankshaft and the primary lift shaft and the primary feed shaft as well as the particular positioning of the cam 128. However, the primary timing differences are effected by the interactions of the previously described elements constituting the apparatus of the present invention. This interaction will now be more particularly described.

Beginning with the wheel-and-arm assembly 18 as shown in FIG. 1, the converted sewing machine has just completed stitching and feeding the material through as indicated above in the step-by-step discussion. In this position the first frame 22 is pivoted to substantially its forward-most position and the workpiece retainer foot 70 is raised. The pivot arm 32 is, at this time, in the position as shown in FIG. 3 and the elements below the work supporting surface 10 are in the positions as shown in FIG. 4.

As the wheel-and-arm assembly 18 is rotated clockwise (as viewed in FIG. 1) to its position in FIG. 6, the main crankshaft moves the primary lift shaft downward. FIG. 4 indicates that as this occurs, the cam shaft 130 will be rotated so that the cam 128 engages the mounting shaft crank 126 which in turn rotates the mounting shaft 124 so that the first feed dog elevation crank 106 depresses the first end 112 of the lever 110. Depressing the first end 112 pivots the lever 110 about the pin extending from the collar 120 so that the second end 114 of the lever 110 is pushed away from the underside of the workpiece supporting surface 10. This pivotation pulls the feed dog arm 116 in the same direction so that the feed dog 8 is moved down from its FIG. 1 position.

The engagement of the cam 128 with the mounting shaft crank 126 also causes the synchronizing linkage means 146 to pivot so that the lift rod 74 is likewise moved downward. As can be visualized in FIG. 2, downward movement of the lift rod 74 pulls the first rod crank 98 downward which causes the second rod crank 102 shown in FIG. 1 to rotate in a counterclockwise direction as viewed therein. This counterclockwise movement is coupled to the bell crank 82 at the third pivot end 92 thereof. This coupled counterclockwise movement pivots the bell crank 82 about the first pivot end 84 so that the second pivot end 88 of the bell crank 82 moves downward to lower the workpiece retainer foot 70 whereby the workpiece is retained against the workpiece supporting surface 10. Thus the bell crank 82 converts the rotational movement of the crank 102 to vertical translational movement. This new position of the bell crank 82 and the workpiece retainer foot 70 are shown in FIG. 6. FIG. 6 also shows the needle 16 which has been raised by the rotation of the wheel-and-arm assembly 18 from its FIG. 1 to its FIG. 6 position.

As the wheel-and-arm assembly 18 is rotated clockwise into its FIG. 7 position, the main crankshaft causes the primary lift shaft to complete its downward travel and additionally moves the primary feed shaft to its downward-most position. As shown in FIG. 4, movement of the primary feed shaft downward rotates the feed direction shaft crank 150 away from the underside of the workpiece supporting surface 10 to rotate the feed direction shaft 152 so that the connection indicated by the reference numeral 154 moves in an upward direction as viewed in FIG. 4. This movement drives the feed dog support arm 116 in the same direction so that the feed dog 8 moves to the rear when the feed dog 8 is viewed from above. Thus, at this point where the wheel-and-arm assembly 18 has been rotated approximately ½ of a complete revolution, the feed dog 8 has been located from its engagement with the workpiece and drawn to the rear in preparation of beginning a new stitch and feed movement.

In addition to moving the feed dog 8 to the rear, the previously mentioned downward movement of the primary feed shaft also moves the feed rod 30 down. FIG. 2 indicates that when the feed rod 30 is pulled down, this pulls the first tube crank 50 down and thereby rotates the crank-containing tube 46. This rotation moves the second tube crank 54 in a clockwise direction as viewed in FIG. 3. This clockwise movement forces the pivot arm 32 to the left as it is viewed in FIG. 3 which thereby pivots the first frame 22 to the right as it is viewed in FIG. 1. In other words, the frame 22 is moved into the position indicated in FIG. 1 by the phantom lines. This change of position is also shown in FIG. 7 which indicates the FIG. 1 position in phantom and the rearward pivoted position in solid lines.

As the first frame 22 is pivoted by its linkage to the pivot arm 32, the feed foot 28 is raised from its engagement with the workpiece by means of the pivotation of the first frame 22 and the completion of the primary lift shaft movement whereby the bell crank 82 is rotated slightly upward thereby retracting the presser rod 20 and the feed foot 28 depending therefrom.

The ultimate positions of the elements at the conclusion of the movement of the wheel-and-arm assembly 18 to its FIG. 7 position are shown in FIG. 7, except for the feed dog 8 which has been moved down and to the rear and which is thus below the surface of the bobbin housing cover plate 12.

Figure 8:
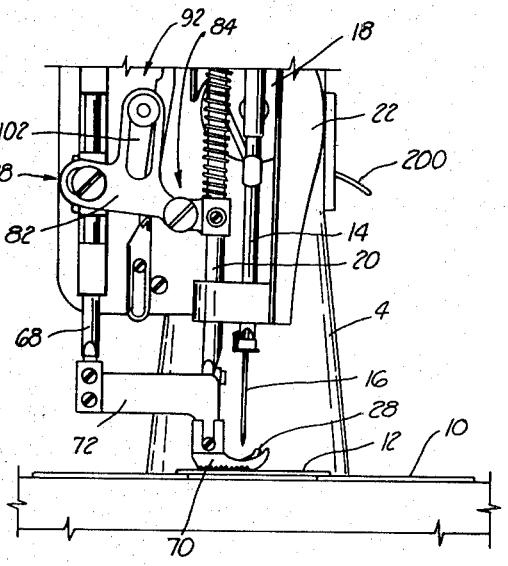
FIG. 8 is a side elevation view of the FIG. 1 embodiment with elements shown in a fourth position.

Rotating the wheel-and-arm assembly 18 clockwise from its FIG. 7 to its FIG. 8 position moves the elements into their next positions of the stitching cycle. In particular, during this portion of the rotation, the main crankshaft draws the primary lift shaft upward, which rotates the camshaft 130 and in turn, rotates the cam 128, the mounting shaft crank 126 and the mounting shaft 124 in the opposite direction from that in which they were rotated in moving from the FIG. 1 to the FIG. 6 position. This movement moves the first end 112 of lever 110 away from the underside of the workpiece supporting surface 10 which thereby pivots the second end 114 of the lever 110 toward the underside of the surface 10 so that the feed dog 8 is thereby raised through its linkage to the lever 110 via the feed dog support arm 116, the forked end 117 and the rotatable sleeve 118.

The upward movement of the primary lift shaft also causes the lift rod 74 to move upward because of the interconnecting synchronizing linkage 146. This upward movement of the lift rod 74 causes the second rod crank 102 to rotate in a clockwise direction as shown by moving from FIG. 7 to FIG. 8. This clockwise movement pivots the bell crank 82 about the second pivot end 88 to lower the presser rod 20 and the feed foot 28 connected thereto. The spring 162 exerts a pressure on the collar 86 to insure the downward movement of the feed foot 28. This clockwise movement of the second rod crank 102 also causes the first frame 22 to slightly pivot farther to the rear.

The next portion of the cycle completes the entire stitch, feed and return cycle when the wheel-and-arm assembly 18 is moved from its FIG. 8 position back to its FIG. 1 position. As this rotation occurs, the main crankshaft pulls the primary feed shaft upward in addition to completing the upward movement of the primary lift shaft. This upward movement of the primary feed shaft rotates the feed direction shaft 152 in the direction opposite that in which it was moved during the FIG. 6 to FIG. 7 portion of the cycle. That is, in moving from the FIG. 8 to the FIG. 1 position, the connection 154 is rotated downward as shown in FIG. 4 so that the feed dog 8 is moved forward in the feed direction.

Simultaneous with the forward movement of the feed dog 8 is the forward pivotation of the first frame 22 and the needle bar 14, the needle 16, the presser bar 20 and the feed foot 28 yoked by the first frame. This forward pivotation of the frame 22 occurs because as the primary feed shaft is pulled upward, the feed rod 30 is likewise moved upward. This rotates the second tube crank 54 in a counterclockwise direction as viewed in FIG. 3 which thereby pulls the pivot arm 32 to the right as it is viewed in FIG. 3. As viewed in FIG. 1, this movement of the pivot arm 32 pulls the first frame 22 to the left in the feed direction.

As the first frame 22 is pivoted in the feed direction, the coupling established by the bell crank 82 forces the workpiece retainer rod 68 and the workpiece retainer foot 70 connected thereto to be raised so that the workpiece may be fed forward.

In addition to the preceding movements occuring during the various sectors of the rotation of the wheel-and-arm assembly 18, the needle 16 is retracted from the sewn stitch and then driven downward to effect the next stitch. The relative positions of the needle 16 during the previously discussed portions of the cycle are shown in FIGS. 1 and 6–8.

With reference now to FIGS. 4 and 9, a description of the operation of the adjustable hook throw mechanism will be given. In general, the hook is contained within the hook-and-bobbin housing 13 on the throw mechanism 144 and is oscillated by the primary lift shaft acting through the forked extension 140 of the camshaft 130 and through the hook throw crank 134 and the hook throw rod 142 to first grab the thread which is pushed through the workpiece by the needle and to then pull the thread down for looping, or throwing, it around the bobbin so that the bobbin thread then extends through the interior of the loop. This is how the stitches of the needle-fed thread are retained in the workpiece and is known by those having ordinary skill in the art. On domestic sewing machines, the amount of throw of the hook (that is, the amount of needle-fed thread pulled down by the hook for looping over the bobbin, or, in other words, the degree of oscillatory rotation imparted to the hook once it has hooked the needle-fed thread) is not adjustable. Thus, the positioning of the hook and the size of the loop cannot be varied. However, it is often desirable to have an adjustable amount of throw so that better sewing can be obtained with a particular machine or a particular material.

The apparatus of the present invention includes the means for providing this adjustability feature. As previously mentioned, this means includes the variable length arm 136 shown in FIGS. 4 and 9. As the arm length is changed, or as the arm is repositioned on the crank 134 to change its effective length with respect to the crank, the distance that the block 138 extends from the axis of rotation of the crank is varied. It is apparent from FIGS. 4 and 9 that by changing this distance, the degree of rotation of the crank 134, and thus the degree of rotation of the hook, is also changed because of the variable length acted on by the forked extension 140. In this fashion the amount of throw of the hook is made adjustable.

Figure 11:
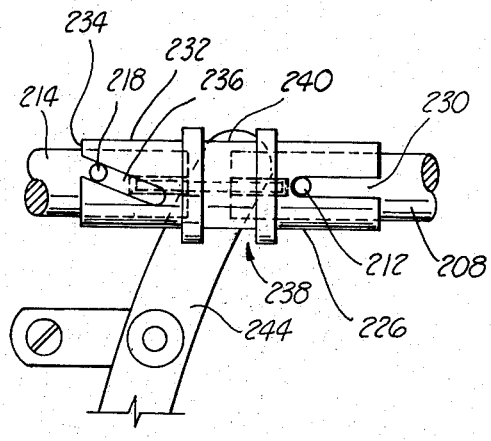
FIG. 11 is a partial view of the repositioning means shown in FIG. 10 when the sewing machine is in a forward stitch mode.
Figure 12:
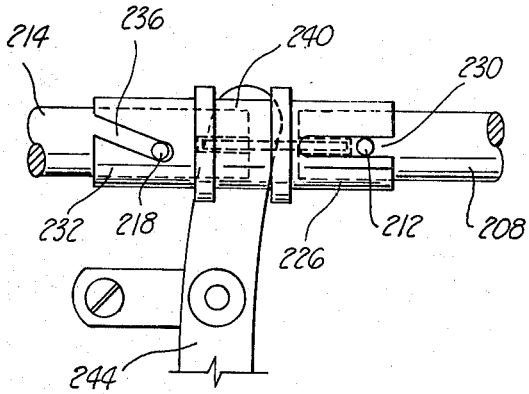
FIG. 12 is a partial view of the repositioning means shown in FIG. 10 when the sewing machine is in the reverse stitch mode.

With reference to FIGS. 10–12, the operation of the repositioning means 202 of the present invention will be described. With the lever 200 in the down position as shown in FIGS. 1 and 6–8 the throw mechanism 144 is in a first position and the second hook throw rod section 214 is in a first position relative to the first hook throw rod section 208 as shown in FIG. 11 of the drawings. With the second hook throw rod section 214 and throw mechanism 144 in their respective first positions and the lever 200 in its down position, the sewing machine is in its forward stitch direction mode whereby the needle bar assemblage, or compound needle feed mechanism is operated to effect a forward stitch in proper synchronization with the throw mechanism and the hook contained thereon. When a reverse stitch direction is desired, the lever 200 is raised to an upper position thereby causing the needle bar assemblage to move with respect to the throw mechanism. If the throw mechanism were not correspondingly moved to maintain synchronization with the needle bar assemblage, the hooking action of the sewing machine would not properly occur. To compensate for the movement of the needle bar assemblage so that sychronization is maintained, the repositioning means of the present invention is used.

When the lever 200 is raised to change the stitch direction and thus the position of the needle bar assemblage, the wire 250 is pulled by the lifting action of the lever 200. The pulling of the wire pivots the arcuate member 244 in a counter-clockwise direction as viewed in FIG. 10. The counter-clockwise movement of the arcuate member 244 slides the first and second sleeves 226 and 232 to the left as viewed in FIG. 10 and forces the second radially extending pin 218 and the second hook throw rod section 214 to pivot downward to a second position relative to the first hook throw rod section 208 as shown in FIG. 12. This downward rotation of the second hook throw rod section 214 moves the throw mechanism 144 and the hook contained thereon to a corresponding position with reference to the needle bar assemblage. Thus, the throw mechanism and the hook contained thereon are repositioned to retain synchronous coaction with the needle bar assemblage during the reverse stitch direction operation of the sewing machine.

When the forward stitch direction mode is again desired, the lever 200 is released to its downward position. This release removes the tension from the wire 250 and permits the spring 248 to contract thereby pivoting the arcuate member 244 in a clock-wise direction as viewed in FIG. 10. The first and second sleeves 226 and 232 move to the right so that the second hook throw rod section 214 returns to its forward stitch direction mode position as shown in FIG. 11.

To achieve correct alignment of the throw mechanism with the needle bar assemblage, the arcuate member 244 includes the slot 246 so that the adjustable connector means 254 can be placed at an appropriate position within the slot to achieve the proper degree of movement when the lever 200 is moved between the up and down positions.

Thus, by attaching the hereinabove described apparatus to a domestic sewing machine, a relatively inexpensive sewing machine is obtained which is capable of sewing heavier material because of its top and bottom workpiece gripping mechanisms. The converted machine is also capable of maintaining in alignment material having designs which are to be matched at the seams because of the interaction between the feed dog and feed foot, along with the retainer foot, whereby the edges of the seams are held together during both feed and reverse-feed direction movements. Also a machine having the capability of adjusting the amount of hook throw is achieved. Further, a machine which can sew in either a forward or a reverse direction using an oscillatory throw mechanism in conjunction with a compound needle feed mechanism is achieved. Thus, the present invention is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. An apparatus for permitting a sewing machine having an oscillatory throw mechanism to function with a compound needle feed mechanism forming a part of the sewing machine so that the sewing machine selectably provides either a forward stitch direction or a reverse stitch direction, said apparatus comprising:

oscillation means for imparting oscillatory movement to said throw mechanism;

stitch direction control means for controlling the feed direction of said compound needle feed mechanism; and repositioning means, responsive to said stitch direction control means, for repositioning said throw mechanism as the position of said compound needle feed mechanism changes in response to said stitch direction control means.

2. An apparatus as defined in claim 1, wherein said repositioning means includes means for rotating said throw mechanism.

3. An apparatus as defined in claim 2, wherein: 'said oscillation means includes:

oscillation drive means; and connecting means for connecting said oscillation drive means to said throw mechanism, said connecting means including:

a first hook throw rod section having a first end connected to said oscillation drive means and having a first radially extending guide pin; and a second hook throw rod section having a first end connected to said throw mechanism and having a second radially extending guide pin; and said rotating means includes means for coupling said first hook throw rod section with said second hook throw rod section, said coupling means including:

a first sleeve extending over a second end of said first hook throw rod section and having a longitudinally extending guide slot receiving said first guide pin;

a second sleeve, connected to said first sleeve, extending over a second end of said second hook throw rod section and having a guide slot, skewed with respect to the longitudinal axis of said second sleeve, receiving said second guide pin; and sliding means, responsive to said stitch direction control means, for sliding said first and second sleeve with respect to said first and second hook throw rod sections so that said second guide pin coacts with said skewed guide slot to rotate said throw mechanism with respect to said compound needle feed mechanism.

4. An apparatus as defined in claim 3, wherein:

said first hook throw rod section has a longitudinally extending opening in said second end thereof;

said second hook throw rod section has a longitudinally extending opening in said second end thereof; and said connecting means further includes an elongated alignment member movably positioned in, and extending between, said openings in said first and second hook throw rod sections.

5. An apparatus as defined in claim 3, wherein said sliding means includes:

an arcuate member, pivotally connected to said sewing machine, having a first end associated with said first and second sleeves; and means, responsive to said stitch direction controlling means, for pivoting said arcuate member so that said first and second sleeves slide with respect to said first and second hook throw rod sections.

6. Apparatus for converting a sewing machine capable of sewing lightweight material to one capable of sewing heavier material and also capable of maintaining the material's seam connectable designs in alignment and further capable of repositioning a throw mechanism included within the sewing machine when the sewing machine is switched between a forward stitch mode and a reverse stitch mode, the unconverted sewing machine having a main crankshaft coupled to a primary lift shaft and to a primary feed shaft and further having a feed dog for feeding a workpiece across a workpiece supporting surface of the machine, said apparatus comprising:

means for pivotally connecting a needle bar and a feed foot to said sewing machine;

means, responsive to actuation of said primary feed shaft, for oscillatably pivoting said pivotal connecting means in a feed direction and a reverse feed direction;

means, responsive to actuation of said primary lift shaft, for clamping said workpiece against said workpiece supporting surface during said reverse feed direction pivotation;

means, responsive to actuation of said primary lift shaft, for lowering and raising said feed dog at the substantial extreme of said feed direction pivotation and at the substantially extreme of said reverse direction pivotation, respectively;

stitch direction control means for controlling said feed direction of said needle bar; and repositioning means, responsive to said stitch direction control means, for repositioning said throw mechanism as the position of said needle bar changes in response to said stitch direction control means.

7. An apparatus as defined in claim 6, wherein said repositioning means includes means for rotating said throw mechanism.

8. An apparatus as defined in claim 7, wherein:

said apparatus further comprises means for oscillating said throw mechanism as said pivotal connecting means pivots in said feed and reverse feed directions, said oscillating means including: oscillation drive means; and connection means for connecting said oscillation drive means to said throw mechanism, said connection means including:

a first hook throw rod section having a first end connected to said oscillation drive means and having a first radially extending guide pin; and a second hook throw rod section having a first end connected to said throw mechanism and having a second radially extending guide pin; and said rotating means includes means for coupling said first hook throw rod section with said second hook throw rod section, said coupling means including:

a first sleeve extending over a second end of said first hook throw rod section and having a longitudinally extending guide slot receiving said first guide pin;

a second sleeve, connected to said first sleeve, extending over a second end of said second hook throw rod section and having a guide slot, skewed with respect to the longitudinal axis of said second sleeve, receiving said second guide pin; and sliding means, responsive to said stitch direction control means, for sliding said first and second hook throw rod sections so that said second guide pin coacts with said skewed guide slot to rotate said throw mechanism and thereby reposition said throw mechanism with respect to said needle bar.

9. An apparatus as defined in claim 8, wherein:

said first hook throw rod section has a longitudinally extending opening in said second end thereof;

said second hook throw rod section has a longitudinally extending opening in said second end thereof; and said connection means further includes an elongated alignment member movably positioned in, and extending between, said openings in said first and second hook throw rod sections.

10. An apparatus as defined in claim 8, wherein said sliding means includes:

an arcuate member, pivotally connected to said sewing machine, having a first end associated with said first and second sleeves; and means, responsive to said stitch direction controlling means, for pivoting said arcuate member so that said first and second sleeves slide with respect to said first and second hook throw rod sections.

11. An apparatus for attachment to a sewing machine having a main crankshaft coupled to a primary lift shaft and to a primary feed shaft, and further having a bottom workpiece feed mechanism comprised of a feed dog disposed within a workpiece supporting surface of the machine and moved in the direction of feed and returned in the opposite direction by the oscillating motion of the primary feed shaft, and also having a vertically oscillated needle bar, and still further having a presser foot attached to a presser bar for urging a workpiece against the workpiece supporting surface and the feed dog, and additionally having a needle-fed thread hook, said apparatus converting the presser foot to a pivotal feed foot and converting the sewing machine to one having a tap and bottom workpiece gripping feed mechanism whereby workpiece of extra thickness can be fed through said mechanism, maintained in edgewise alignment and stitched by the converted machine and said apparatus further converting the sewing machine to one wherein the needle bar can be operated either in a forward stitch direction or a reverse stitch direction and wherein the position of said needle-fed thread hook can be changed to accommodate either the forward stitch direction or the reverse stitch direction, said apparatus comprising:

a first frame pivotally mounted on said sewing machine, said first frame having a plurality of bores defined therein for respectively slidably receiving said needle bar and said presser bar;

a feed foot connected to said presser bar so that said presser-foot-to-feed-foot conversion is effected;

a second frame attached to said sewing machine;

a tubular member substantially vertically connected to said second frame;

a workpiece retainer rod slidably engaged in said tubular member;

means connected to said workpiece retainer rod for retaining the workpiece against said workpiece supporting surface;

a lift rod linked to said primary lift shaft;

a bell crank having a first pivot end pivotally connected to said presser bar and a second pivot end pivotally connected to said workpiece retainer rod;

means for communicating movement by said lift rod to a third pivot end of said bell crank;

a feed rod linked to said primary feed shaft;

a pivot arm having a first end thereof connected to said first frame;

means for transmitting movement by said feed rod to a second end of said pivot arm;

means for raising and lowering said feed dog responsive to said movement by said primary lift shaft;

oscillation means, responsive to said primary lift shaft, for imparting oscillatory movement to said needle-fed thread hook, said oscillation means including:

oscillation drive means; and connecting means for connecting said oscillation drive means to said throw mechanism, said connecting means including:

a first hook throw rod section having a first end connected to said oscillation drive means and having a first radially extending guide pin; and a second hook throw rod section having a first end connected to said throw mechanism and having a second radially extending guide pin;

stitch direction control means for controlling said direction of feed; and repositioning means, responsive to said stitch direction control means, for repositioning said needle-fed thread hook as the feed direction changes in response to said stitch direction control means, said repositioning means including:

a first sleeve extending over a second end of said first hook throw rod section and having a longitudinally extending guide slot receiving said first guide pin;

a second sleeve, connected to said first sleeve, extending over a second end of said second throw rod section and having a guide slot, skewed with respect to the longitudinal axis of said second sleeve, receiving said second guide pin; and sliding means, responsive to said stitch direction control means, for sliding said first and second sleeves with respect to said first and second throw rod sections so that said second guide pin coacts with said skewed guide slot to rotate said needle-fed thread hook and thereby reposition said thread hook with respect to said compound needle feed mechanism.

12. An apparatus as defined in claim 11, wherein said sliding means includes:

an arcuate member pivotally connected to said sewing maching, having a first end associated with said first and second sleeves; and means, responsive to said stitch direction controlling means, for pivoting said arcuate member so that said first and second sleeves slide with respect to said first and second hook throw rod sections.

13. Apparatus for attachment to a sewing maching having a main crankshaft coupled to a primary lift shaft and to a primary feed shaft, and further having a bottom workpiece feed mechanism comprised of a feed dog disposed within a workpiece supporting surface of the machine and moved in the direction of feed and returned in the opposite direction by the oscillating motion of the primary feed shaft, and also having a vertically oscillated needle bar, and still further having a presser foot attached to a presser bar for urging a workpiece against the workpiece supporting surface and the feed dog, and additionally having a needle-fed thread hook, said apparatus converting said presser foot to a feed foot and converting the sewing machine to one having a top and bottom workpiece gripping feed mechanism whereby workpieces of extra thickness can be fed through said mechanism, maintained in edgewise alignment and stitched by the converted machine, said apparatus comprising:

a first frame pivotally mounted on said sewing machine said frame having a plurality of substantially vertically extending bores defined therein for slidably receiving said needle bar and said presser bar;

a feed foot connected to said presser bar so that said presser-foot-to-feed-foot conversion is effected;

a second frame attached to said sewing machine;

a tubular member substantially vertically connected to said second frame;

a workpiece retainer rod slidably disposed in said tubular member;

a workpiece retainer foot connected to said workpiece retainer rod;

a lift rod linked to said primary lift shaft;

a linkage means having a first end pivotally connected to said presser bar and a second end pivotally connected to said workpiece retainer rod;

a crankable rod rotatably connected to said sewing machine, said rod having a first rod crank pivotally connected to said lift rod and having a second rod crank pivotally connected to a third end of said linkage means;

a feed rod linked to said primary feed shaft;

a pivot arm having a first end connected to said first frame;

a crank-containing tube disposed substantially concentrically around said crankable rod, said tube having a first tube crank pivotally connected to said feed rod and having a second tube crank pivotally connected to a second end of said pivot arm;

a first feed dog elevation crank;

a second feed dog elevation crank rotatably retained to said sewing machine;

a lever pivotally mounted on said sewing machine, said lever having a first end connected to said first feed dog elevation crank and having a second end connected to said second feed dog elevation crank, said second end further connected to said feed dog;

means for coupling said first feed dog elevation crank to said primary lift shaft;

oscillation means, responsive to said primary lift shaft, for imparting oscillatory movement to said needle-fed thread hook including:

oscillation drive means; and connecting means for connecting said oscillation drive means to said throw mechanism, said connecting means including:

a first hook throw rod section having a first end connected to said oscillation drive means and having a first radially extending guide pin; and a second hook throw rod section having a first end connected to said throw mechanism and having a second radially extending guide pin;

stitch direction control means for controlling the direction of feed; and repositioning means, responsive to said stitch direction control means, for repositioning said needle-fed thread hook as the position of said needle bar changes in response to said stitch direction control means, said repositioning means including:

a first sleeve extending over a second end of said first hook throw rod section and having a longitudinally extending guide slot receiving said first guide pin;

a second sleeve, connected to said first sleeve and extending over a second end of said second throw rod section and having a guide slot skewed with respect to the longitudinal axis of said second sleeve, receiving said second guide pin; and sliding means, responsive to said stitch direction control means, for sliding said first and second sleeves with respect to said first and second throw rod sections so that said second guide pin coacts with said skewed guide slot to rotate said needle-fed thread hook and thereby reposition said thread hook with respect to said needle bar.

14. An apparatus as defined in claim 13, wherein said sliding means includes:

an arcuate member, pivotally connected to said sewing machine, having a first end associated with said first and second sleeves; and means, responsive to said stitch direction control means, for pivoting said arcuate member so that said first and second sleeves slide with respect to said first and second hook throw rod sections.

15. In a sewing machine of the type having an oscillatory throw mechanism, a compound needle feed mechanism, means for oscillating the oscillatory throw mechanism, and means for controlling the operation of the compound needle feed mechanism so that either a forward stitch direction or a reverse stitch direction is provided, the improvement comprising:

a first hook throw rod section having a first end connected to said means for oscillating the throw mechanism and having a first radially extending guide pin;

a second hook throw rod section having a first end connected to said throw mechanism and having a second radially extending guide pin;

a first tubular sleeve extending over a second end of said first hook throw rod section and having a longitudinally extending guide slot receiving said first guide pin;

a second tubular sleeve, connected to said first tubular sleeve, extending over a second end of said second hook throw rod section and having a guide slot extending obliquely from the unconnected end of said second sleeve toward the connected end of said second sleeve and receiving said second guide pin; and sliding means, responsive to said means for controlling the stitch direction of said compound needle feed mechanism, for sliding said first and second sleeves with respect to said first and second hook throw rod sections so that said second guide pin coacts with said obliquely extending guide slot to rotate said throw mechanism and thereby reposition said throw mechanism with respect to said compound needle feed mechanism.

16. An apparatus as defined in claim 15, wherein said sliding means includes:

an arcuate member, pivotally connected to said sewing machine, having a first end associated with said first and second sleeves; and means, responsive to said means for controlling the stitch direction of said compound feed mechanism, for pivoting said arcuate member so that said first and second sleeves slide with respect to said first and second hook throw rod sections.

* * * * *